United States Patent [19]

Godshalk et al.

[11] Patent Number: 4,992,762

[45] Date of Patent: Feb. 12, 1991

[54] RIDGE-TROUGH WAVEGUIDE

[75] Inventors: Edward M. Godshalk, Beaverton; Keith E. Jones, Aloha, both of Oreg.

[73] Assignee: Cascade Microtech, Inc., Beaverton, Oreg.

[21] Appl. No.: 510,695

[22] Filed: Apr. 16, 1990

[51] Int. Cl.[5] ..... H01P 3/123

[52] U.S. Cl. ..... 333/239; 333/26

[58] Field of Search ..... 333/239, 248; 343/772, 343/776

[56] References Cited

U.S. PATENT DOCUMENTS 2,921,276 1/1960 Fubini ..... 333/239
4,476,363 10/1984 Berggren ..... 333/239 X

FOREIGN PATENT DOCUMENTS 1925732 11/1970 Fed. Rep. of Germany ..... 333/239

OTHER PUBLICATIONS

G. C. Dalman, "New Waveguide-To-Coplanar Waveguide Transition for Centimeter and Millimeter Wave Applications," *Electronics Letters,* vol. 26, No. 13, pp. 830 et seq., (Jun. 1990).

G. E. Ponchak and R. N. Simons, "A New Rectangular Waveguide to Coplanar Waveguide Transition," Presented at *MTTS-S Int. Microwave Symposium,* Dallas, Tex. (May 8-10, 1990).

T. Mazilu, "A Self-Adjusting Waveguide-To-Microstrip Transition," *Microwave Journal,* pp. 133-134 (Jul. 1987).

J. S. Izadian, "Unified Design Plans Aid Waveguide Transitions," *Microwaves & RF,* pp. 213-222 (May 1987).

Tsung-Shan Chen, "Calculation of the Parameters of Ridge Waveguides," *IRE Transactions on Microwave Theory and Techniques,* vol. 5, No. 1, pp. 12-17, (Jan. 57).

S. Hopfer, "The Design of Ridged Waveguides," *IRE Transactions on Microwave Theory and Techniques,* vol. 3, pp. 20-29, (Oct. 1955).

S. B. Cohen, "Optimum Design of Stepped Transmission-Line Transformers," *IRE Transactions on Microwave Theory and Techniques,* pp. 16-21, (Apr. 1955).

S. B. Cohn, "Properties of Ridge Wave Guide," *Proceedings of the IRE,* vol. 35, pp. 783-788 (Aug. 1947).

J. R. Winnery and H. W. Jamieson, "Equivalent Circuits of Discontinuities in Transmission Lines," *Proceedings of the IRE,* vol. 32, pp. 98-116 (Feb. 1944)

*Primary Examiner*—Paul Gensler

*Attorney, Agent, or Firm*—Chernoff, Vilhauer, McClung & Stenzel

[57] ABSTRACT

A waveguide configuration have a longitudinal ridge directly opposing a longitudinal trough. The ridge provides broadband signal transmission characteristics of ridge waveguides and may extend within the trough to result in a virtually horizontal electric field configuration.

4 Claims, 6 Drawing Sheets

RIDGE-TROUGH WAVEGUIDE

BACKGROUND OF THE INVENTION

The present invention relates to the field of waveguides for microwave signal transmission. Specifically, it pertains to waveguide configurations which, in cross section, have a ridge directly opposing a trough.

Typical hollow tubular waveguides are useful for transmitting microwave frequency signals. Unfortunately, such waveguides do not easily connect to coplanar waveguides. Furthermore, such waveguides may not have sufficient bandwidth.

Previously, ridge waveguides have been used when large bandwidth transmission capabilities are desired. Ridge waveguides also have been a convenient means of transforming the high impedance associated with waveguides to the relatively low impedance typically associated with dielectric-based transmission line structures, such as microstrip. Ridge waveguides generate a quasi-TEM field configuration which closely replicates the field configuration of microstrip transmission lines. Unfortunately, the ridge waveguide's quasi-TEM field configuration is very different from the field configuration of a coplanar waveguide's. Electrical connection between a ridge waveguide and a coplanar waveguide thus results in signal reflection and corresponding insertion loss.

What is needed, then, is a waveguide configuration which retains the broadband transmission capabilities of ridge waveguides yet provides a horizontal electric field configuration for efficient electrical connection to coplanar waveguides.

SUMMARY OF THE INVENTION

The present invention is directed to waveguide configurations which have a longitudinal ridge directly opposing a longitudinal trough. The ridge provides the broadband signal transmission characteristics of ridge waveguides and may extend within the trough to result in a virtually horizontal electric field configuration.

It is therefore a principal object of the present invention to provide a waveguide configuration capable of broadband signal transmission.

It is another principal object of the present invention to provide a waveguide configuration which efficiently connects to coplanar waveguides without substantial reflection or attenuation.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
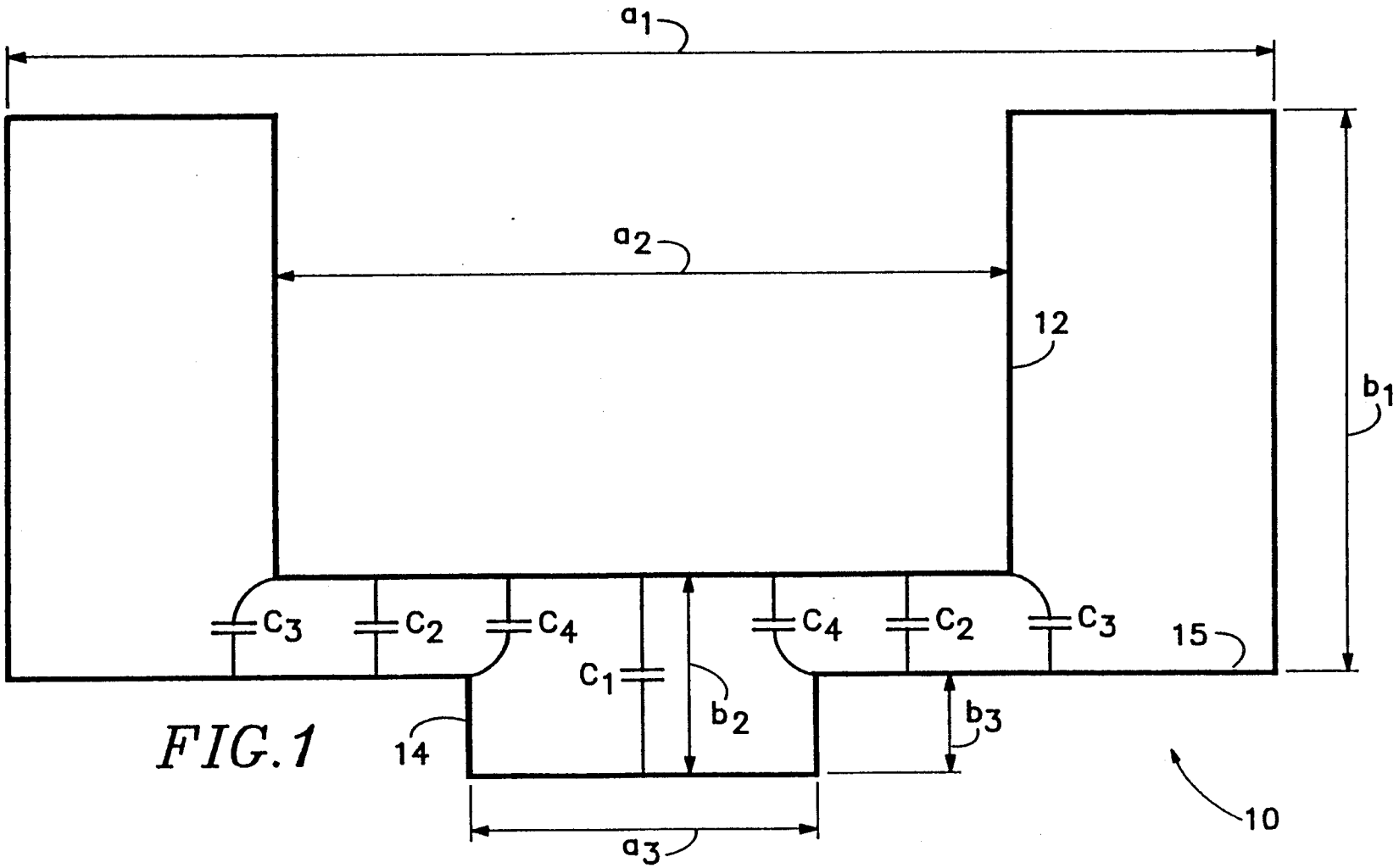
FIG. 1 is a transverse sectional view of an exemplary ridge-trough waveguide according to the present invention with virtual capacitors representing capacitances between various locations.
Figure 2:
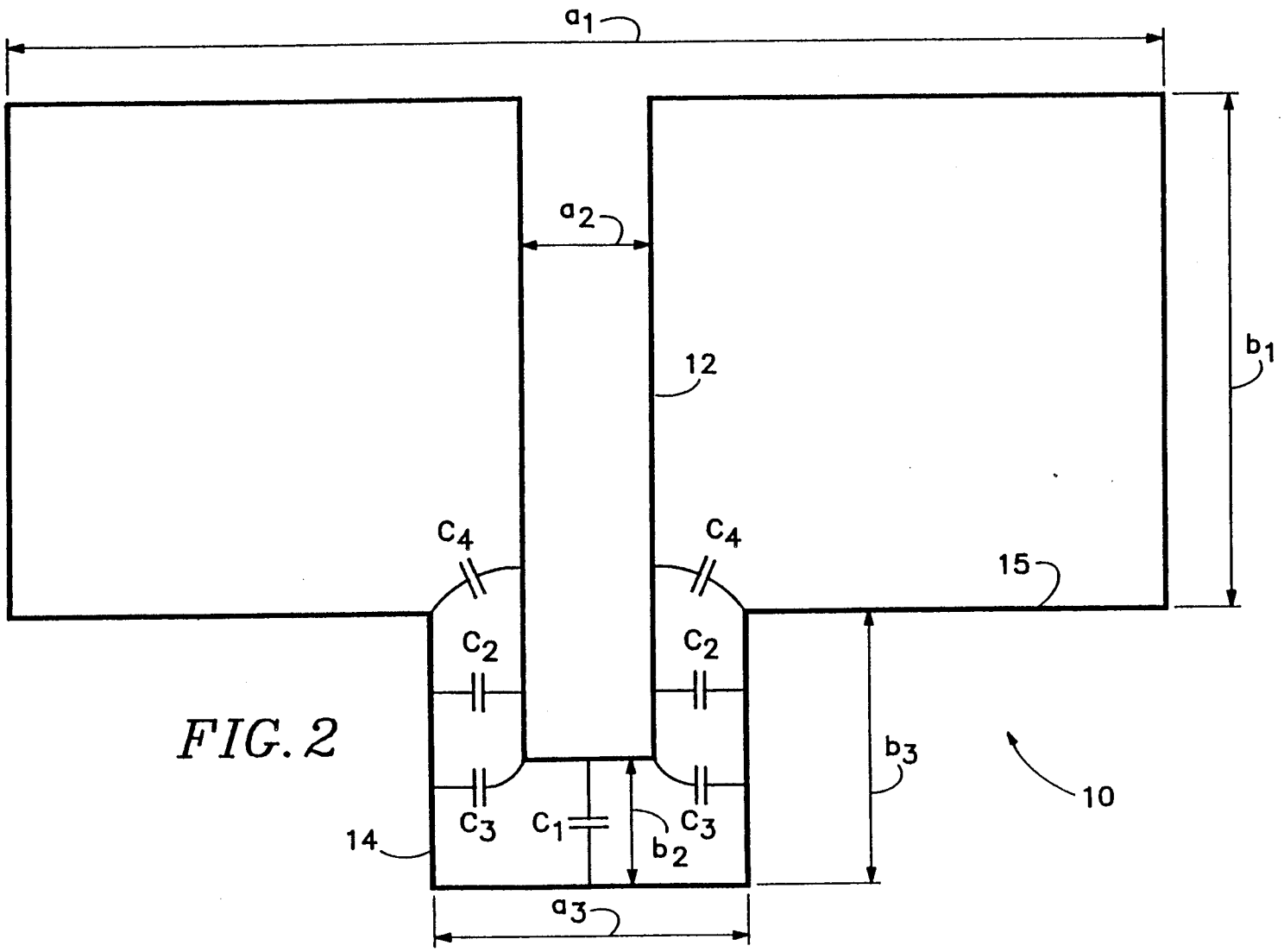
FIG. 2 is transverse sectional view of another exemplary ridge-trough waveguide according to the present invention with virtual capacitors representing capacitances between various locations.

Referring to FIGS. 1–2 of the drawings, wherein like reference numerals refer to like elements, a ridge-trough waveguide 10 has an internal longitudinal ridge 12 directly opposing an internal longitudinal trough 14. Three different ridge-trough waveguide configurations are differentiated by their relative sizes and positions of the ridges and troughs. In a first configuration (FIG. 1) the ridge's transverse width $a_2$ is greater than the trough's transverse width $a_3$. In a second configuration (FIG. 2) the ridge's transverse width $a_2$ is narrower than the trough's transverse width $a_3$, and the ridge extends into the trough, that is, measurement $b_2$ is less than measurement $b_3$. In a third configuration (not shown), the ridge is narrower than the trough, yet does not extend into the trough.

The ridge-trough waveguides shown in FIGS. 1–2 are based on rectangular waveguides. It will be apparent that such a limitation is not necessary for proper functioning or to gain the advantages of a ridge-trough waveguide configuration. Additionally, the proportions shown in FIGS. 1–2 are exaggerated to show the geometric relations of the different ridge-trough configurations.

Figure 3:
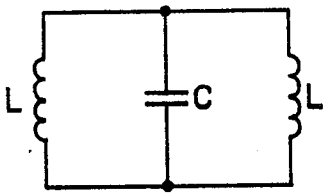
FIG. 3 is a schematic diagram of a circuit useful for modeling the behavior of ridge and ridge-trough waveguides.

Two important design parameters of waveguides are cutoff frequency $f_c$ and characteristic impedance $Z_0$. The electrical characteristics per unit length of both ridge waveguides and ridge-trough waveguides can be modeled by the circuit shown in FIG. 3. Each inductor L models the inductance from the longitudinal center of the ridge 12 to the portion of the waveguide directly opposite the ridge. In a ridge-trough waveguide, the ridge directly opposes the trough 14. The two inductors represent the two alternate paths through which current can flow. A capacitor C models the capacitance between the ridge and the rest of the waveguide.

Cutoff Frequency $f_c$

The lower cutoff frequency $f_c$ for a ridge or ridge-trough waveguide is the resonant frequency of the shown parallel LC circuit, thus $$f_c = \frac{\omega_c}{2\pi} = \frac{1}{2\pi\sqrt{\frac{L}{2}C}}. \quad (1)$$

Figure 4:
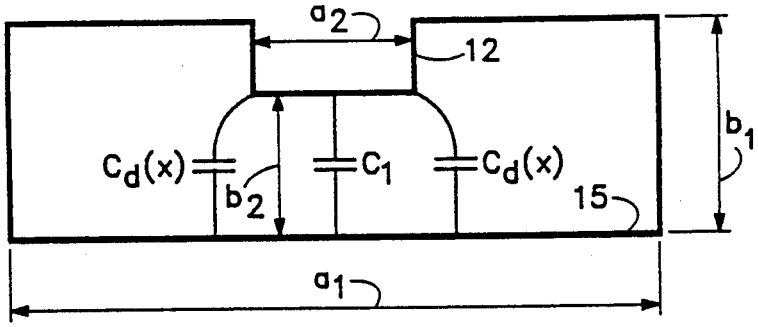
FIG. 4 is a transverse sectional view of a ridge waveguide with virtual capacitors representing capacitances between various locations.

The inductance and capacitance values for ridge waveguides are published in the prior art. Using the notation given in FIG. 4, these values are given by the equations $$L = \frac{\mu(a_1 - a_2)}{2}(b_1) \quad (2)$$

$$C = \frac{\epsilon a_2}{b_2} + 2C_d(x). \quad (3)$$

Figure 5:
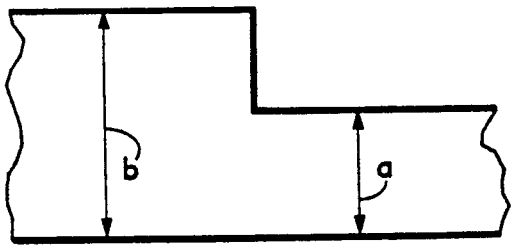
FIG. 5 is a sectional view of a stepped waveguide section.

The first term on the right side of equation (3) represents the electrostatic, parallel-plate capacitance between the waveguide's ridge 12 and floor 15, while $C_d(x)$ represents the discontinuity capacitance present at the bottom corners of the ridge. As described in Tsung-Shan Chen, "Calculation of the Parameters of Ridge Waveguides," *IRE Transactions on Microwave Theory and Techniques*, vol. 5, no. 1, pp. 12–17, (Jan. 1957), this discontinuity capacitance can be closely approximated by one of the fringing capacitance formulas developed by Whinnery and Jamieson and published in J.R. Whinnery and H. W. Jamieson, "Equivalent Circuits of Discontinuities in Transmission Lines," *Proceedings of the IRE*, vol. 32, pp. 98–116 (Feb. 1944). Referring to the stepped waveguide geometry shown in FIG. 5, the formula for $C_d(x)$ is $$C_d(x) = \frac{\epsilon}{\pi}\left[\frac{x^2+1}{x}\cosh^{-1}\left(\frac{1+x^2}{1-x^2}\right) - 2\ln\left(\frac{4x}{1-x^2}\right)\right] \quad (4)$$

where x equals the ratio a/b. Thus, the ratio x for equation (3) is $b_2/b_1$.

A similar analysis yields useable results for a ridge-trough waveguide. The ridge-trough waveguide is assumed to have the same inductance L as a ridge waveguide. Thus, the inductances of the ridge-trough waveguide configurations shown in FIGS. 1 and 2 can be modeled by equation (2).

Compared to a ridge waveguide, a ridge-trough waveguide has a more complex geometrical configuration. Thus the equations which describe a ridge-trough waveguide's capacitance are also more complex. The capacitance C of equation (1) for the ridge-trough waveguides shown in FIGS. 1 and 2 is given by $$C = C_1 + 2(C_2 + C_3 + C_4). \quad (5)$$

Capacitance $C_1$ is the electrostatic capacitance between the ridge and the center of the trough and can be modeled by $$C_1 = \epsilon\frac{a_3}{b_2} \quad (6)$$

for the ridge-trough waveguide configuration of FIG. 1 and by $$C_1 = \epsilon\frac{a_2}{b_2} \quad (7)$$

for the ridge-trough waveguide configuration of FIG. 2. Likewise, capacitance $C_2$ represents the additional electrostatic capacitance between the ridge and the floor of the ridge-trough waveguide shown in FIG. 1, or between the ridge and the sides of the trough of the ridge-trough waveguide shown in FIG. 2. Thus, $C_2$ can be modeled by the equations $$C_2 = \epsilon\frac{a_2 - a_3}{2(b_2 - b_3)} \quad (8)$$

and $$C_2 = \epsilon\frac{2(b_3 - b_2)}{a_3 - a_2} \quad (9)$$

for FIGS. 1 and 2, respectively.

Capacitances $C_3$ represents the fringing capacitances from the bottom corners of the ridge, and can be modeled by $$C_3 = C_d(x) \quad (10)$$

where $C_d(x)$ is the function given in equation (4), and where x is the ratio $(b_2-b_3)/b_1$ and the ratio $(a_3-a_2)/2a_3$ for FIGS. 1 and 2, respectively. Although the Whinnery and Jamieson model does not exactly agree with the configuration of FIG. 2, in that the ridge 12 does not contact either side of the trough 14, for the purposes of this model, the proximity of the ridge to the trough relative to the ridge's width $a_2$ lessens any errors this assumption introduces.

Capacitances $C_4$ represent the fringing capacitances between the upper corners of the trough 14 and the ridge 12. Capacitances $C_4$ also can be modeled by $$C_4 = C_d(x) \quad (11)$$

where $C_d(x)$ given in equation (4) where x is the ratio $(b_2-b_3)/b_2$ and the ratio $(a_3-a_2)/(a_1-a_2)$ for FIGS. 1 and 2, respectively.

Characteristic Impedance $Z_0$

A ridge or ridge-trough waveguide's characteristic impedance can be found by determining the voltage-to-current ratio as described in Chen, cited above. The characteristic impedance $Z_0$ is $$Z_0 = \frac{V_0}{(I_{Z1} + I_{Z2})} = \frac{Z_{0\infty}}{\sqrt{1 - \left(\frac{f_c}{f}\right)^2}} \quad (12)$$

where $I_{Z1}$ and $I_{Z2}$ are the two components of the current. Current $I_{Z1}$ is the longitudinal current component on the top and bottom plates which excites the waveguide's principal fields while $I_{Z2}$ is the longitudinal current component which produces local fields at the waveguide height changes.

A ridge waveguide's characteristic impedance at infinite frequency $Z_{0\infty}$ is shown by Chen to be $$Z_{0\infty} = \frac{\sqrt{\frac{\mu}{\epsilon}}}{\frac{2C_d(x)}{\epsilon}\cos\theta_2 + \frac{1}{\pi}\frac{\lambda_c}{b_2}\left(\sin\theta_2 + \frac{b_2}{b_1}\cos\theta_2\tan\frac{\theta_1}{2}\right)} \tag{13}$$

where $\lambda_c = 1(f_c c)$ is the wavelength of the signal corresponding to the cutoff frequency, and $C_d(x)$ is the fringing capacitance for a ridge waveguide as discussed above in connection with equation (4).

Using a similar analysis, the characteristic impedance at infinite frequency $Z_{0\infty}$ for a ridge-trough waveguide as shown in FIG. 1 is $$Z_{0\infty} = \frac{\sqrt{\frac{\mu}{\epsilon}}}{\left\{\frac{\lambda_c}{b_2\pi}\left\{\sin\theta_3 + b_2\frac{\cos\theta_3}{\sin(\theta_1+\theta_2)}\left[\cos\theta_1\cdot\left(\frac{1}{b_2-b_3}-\frac{1}{b_1}\right)-\frac{\cos(\theta_1+\theta_2)}{b_2-b_3}+\frac{1}{b_1}\right]\right\}+\frac{2\cos\theta_3}{\epsilon}\left(C_3+\frac{C_1\sin\theta_1}{\sin(\theta_1+\theta_2)}\right)\right\}} \tag{14}$$

where $\theta_1$, $\theta_2$, and $\theta_3$ represent the phase angle change in the voltage across the waveguide, starting with a maximum at the center of the ridge and decreasing to zero at the side wall. Angle $\theta_1$ is the phase angle change in the horizontal distance between the waveguide's side wall and the edge of the center ridge, thus $$\theta_1 = \frac{\pi(a_1 - a_2)}{\lambda_c} \tag{15}$$

Angle $\theta_2$ is the phase angle change in the horizontal distance between the edge of the center ridge and the edge of the trough, that is, the distance of overlap between the ridge 12 and the floor 15, thus $$\theta_2 = \frac{\pi(a_2 - a_3)}{\lambda_c} \tag{16}$$

Angle $\theta_3$ is the phase angle change in the horizontal distance between the edge of the trough and the center of the trough, thus $$\theta_3 = \frac{\pi a_3}{\lambda_c} \tag{17}$$

Repeating this analysis for the waveguide configuration shown in FIG. 2 yields a $Z_{0\infty}$ of $$Z_{0\infty} = \frac{\sqrt{\frac{\mu}{\epsilon}}}{\left\{\frac{\sin\theta_3}{b_2}+\frac{\cos\theta_3}{\sin(\theta_1+\theta_2)}\left[\left(\frac{2}{a_3-a_2}-\frac{1}{b_1}\right)\cos\theta_1-\frac{2\cos(\theta_1+\theta_2)}{a_3-a_2}+\frac{1}{b_1}\right]+\frac{2\cos\theta_3}{\epsilon}\left[C_3+C_1\frac{\sin\theta_1}{\sin(\theta_1+\theta_2)}\right]\right\}} \tag{18}$$

where $\theta_1$, $\theta_2$, and $\theta_3$ again represent the phase angle change in the voltage across the waveguide. Angle $\theta_1$ is the phase angle change within the horizontal distance between the waveguide's side wall and the edge of the center ridge, and is thus the same as defined in equation (15) above. Angle $\theta_2$ is the phase angle change within the vertical distance where the ridge 12 overlaps the edge of the trough 14, thus $$\theta_2 = \frac{2\pi(b_3 - b_2)}{\lambda_c}. \tag{19}$$

Angle $\theta_3$ is the phase angle change within the horizontal distance between the edge of the ridge and the center of the ridge, thus $$\theta_3 = \frac{\pi a_2}{\lambda_c}. \tag{20}$$

Once the characteristic impedance at infinite frequency $Z_{0\infty}$ has been determined, the characteristic impedance $Z_0$ at any selected signal frequency f can be calculated using the equation $$Z_0 = \frac{Z_{0\infty}}{\sqrt{1-\left(\frac{f_c}{f}\right)^2}}. \tag{21}$$

Figure 6:
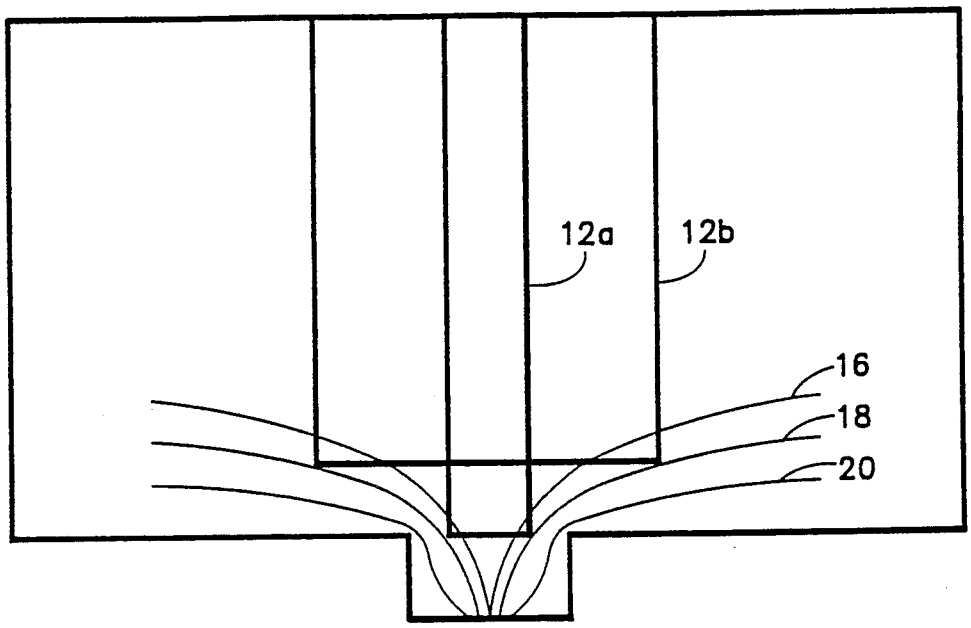
FIG. 6 is a transverse sectional view of a ridge-trough waveguide showing loci of ridge corner locations which result in constant characteristic impedances.

Using the characteristic impedance equations discussed above, the various dimensions of a ridge-trough waveguide can be calculated. Referring to FIG. 6, the lines 16, 18 and 20 represent loci of the bottom corners of the ridge 12 which result in constant characteristic impedances. Thus, ridges 12*a* and 12*b* result in the same characteristic impedance because their bottom corners are on line 18.

Because the above equations assumed the ridge 12 is either wider than the trough, or extends into the trough, the loci in FIG. 6 are estimated for those locations where the ridge is narrower than the trough, yet does not extend within the trough. It will be apparent that alternative means for determining the characteristic impedance of a ridge-trough waveguide, such as finite element analysis can be advantageously used for these and other ridge-trough waveguide configurations.

Figure 7:
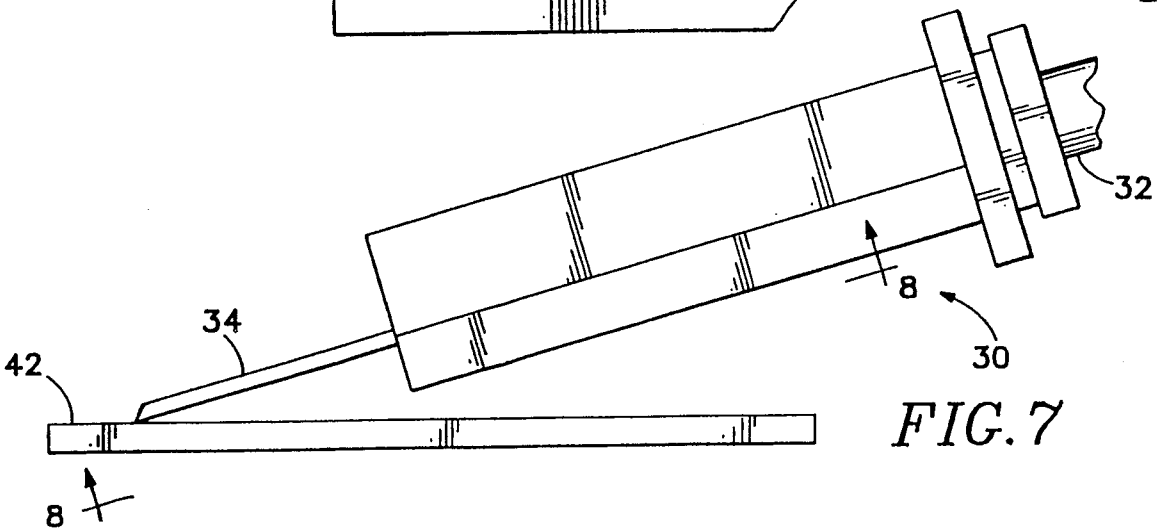
FIG. 7 is an elevational view of an exemplary rectangular waveguide to coplanar microstrip transition coupling a coplanar probe with a rectangular waveguide.

An exemplary rectangular waveguide to coplanar microstrip transmission line transition 30 which includes a ridge-trough waveguide according to the present invention is shown coupling a rectangular waveguide 32 to a multi-conductor coplanar probe 34 in FIG. 7. The transition 30 converts the TE mode signal of the waveguide 32 to a quasi-TEM mode signal. This electrical field configuration of the quasi-TEM mode signal closely matches that of a TEM signal, enabling the transition to effectively connect to the coplanar probe. The probe has ground and signal conductors arranged to allow electrical contact with a wafer 42.

Figure 8:
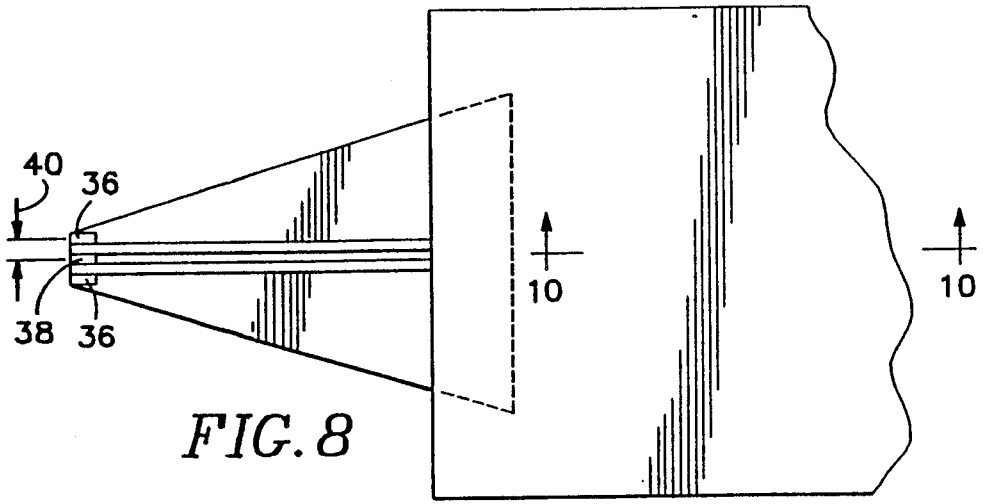
FIG. 8 is a partial plan view of the coplanar probe taken along line 8—8 of FIG. 7.

Referring now to FIG. 8, which shows a bottom view of the probe 34, the arrangement of the ground and signal conductors can be more clearly seen. Two outer ground conductors 36 and an inner signal conductor 38 are shown spaced at pitch 40. The conductors 36, 38 are metal-plated paths on an insulative substrate. The pitch 40 matches that of the signal conductors (not shown) on wafer 25 (FIG. 7).

Figure 9:
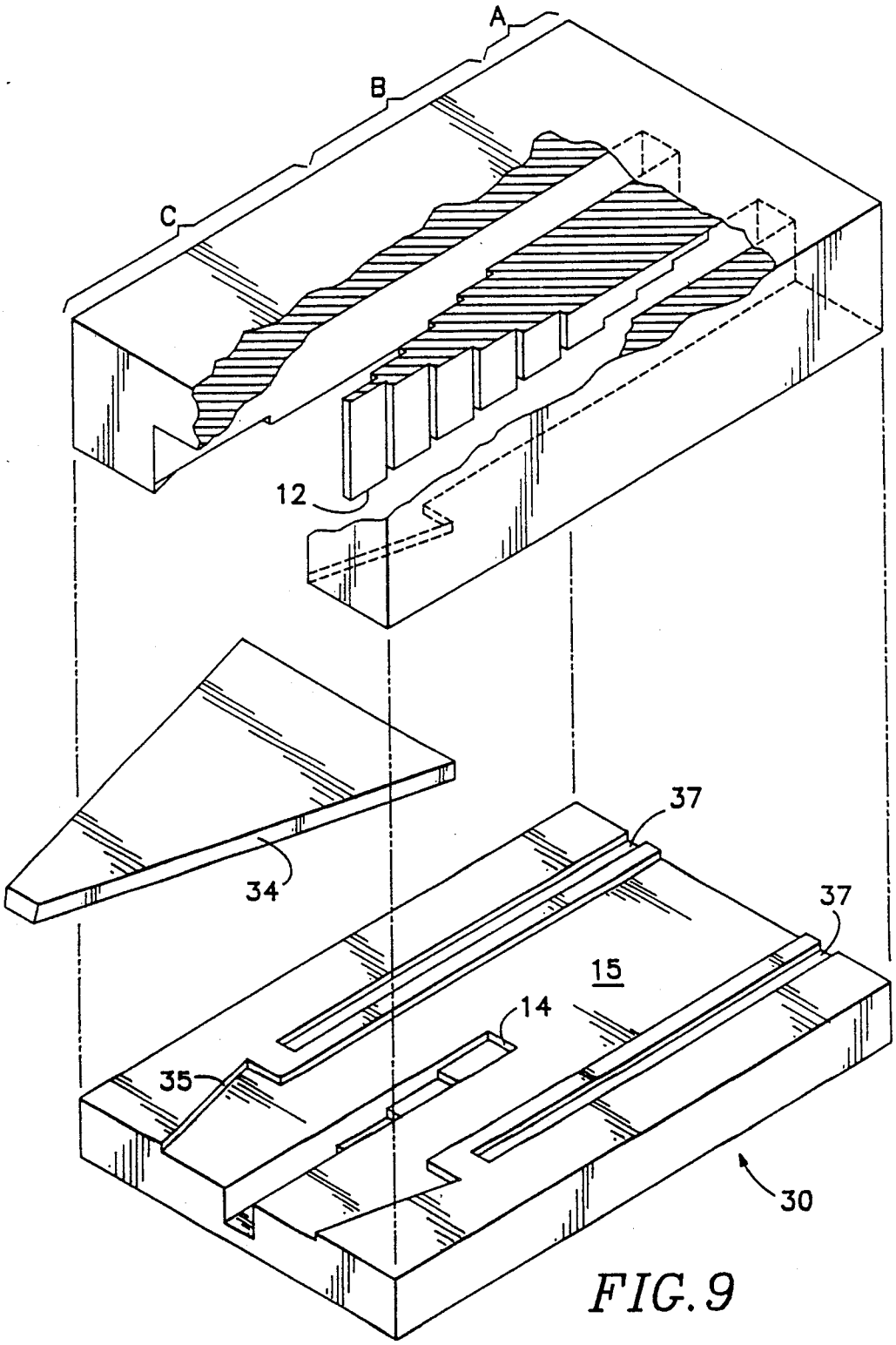
FIG. 9 is an exploded perspective view of said exemplary transition of FIG. 7.

The exemplary transition 30 of FIG. 7 is shown in an exploded view in FIG. 9. This view shows the progression of the transition from a rectangular waveguide in section A, to a ridge waveguide in section B. A trough 14 is introduced into the bottom wall, or "floor," 15 of the waveguide in section C and continues through to the end of the transition, resulting in a ridge-trough configuration. Directly adjacent the coplanar transmission line probe 34, the ridge 12 extends within the trough, causing the E-field to be in a predominantly horizontal direction, matching that of the coplanar probe, as will be shown below. The coplanar probe fits within a recess 35, making electrical contact with the ridge-trough waveguide. The inner signal conductor 38 (FIG. 8) is connected to the ridge 12 while the two outer ground conductors 36 are connected to the floor 15 of the waveguide. Also shown in FIG. 9 are two rectangular grooves 37 which act as RF chokes.

Figure 10:
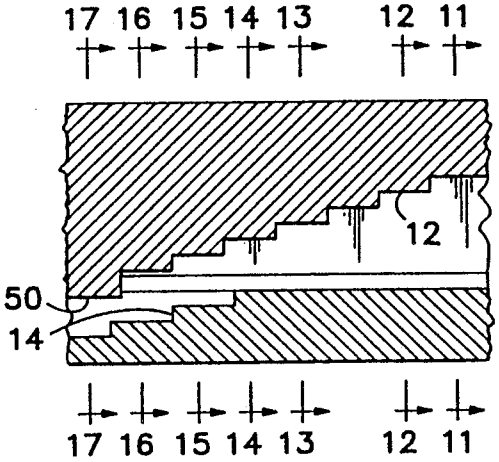
FIG. 10 is a longitudinal sectional elevational view of said transition taken along line 10—10 of FIG. 8.

Referring now to FIG. 10, the transition 30 is shown in a cross-sectional view, clearly showing the introduction of the ridge 12 and trough 14. The ridge is introduced in a stepwise fashion approximating a Chebyshev function, thus minimizing signal reflections while transforming the characteristic impedance of the waveguide. Other transitions, such as a cosine-squared taper, could alternatively be used. Preferably, the steps are approximately one-quarter wavelengths, causing any signal reflections to destructively interfere.

Figure 15:
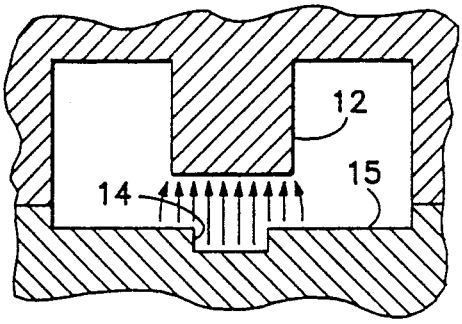
FIGS. 15–17 are transverse sectional elevational views, at increasing scales, of said transition showing ridge-trough waveguide configurations and their respective associated electrical field arrangements, taken along lines 15—15, 16—16, and 17—17, respectively, of FIG. 10.
Figure 16:
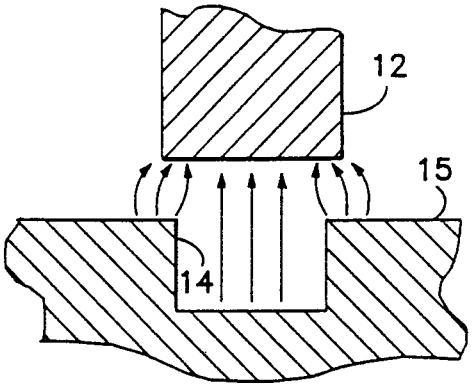
Figure 17:
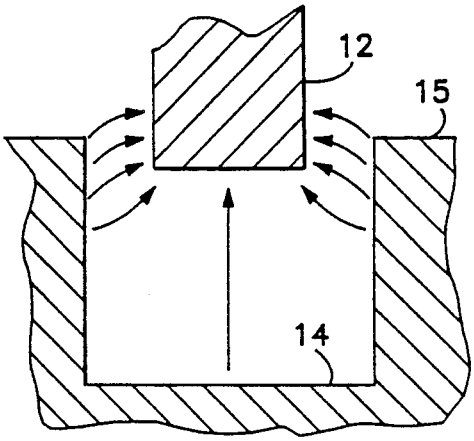

The trough 14 is introduced into the floor of the waveguide in section C, resulting in a ridge-trough waveguide configuration. As shown in FIGS. 15–17, the ridge 12 is brought progressively closer to the trough 14 until it extends within the trough. The electric field is converted from a primarily vertical field configuration in FIG. 15 to a primarily horizontal field configuration in FIG. 17. The ridge need not extend within the trough to gain the advantages of a horizontal field configuration; a primarily horizontal electric field results when the ridge approaches the floor 15 of the waveguide.

Figure 11:
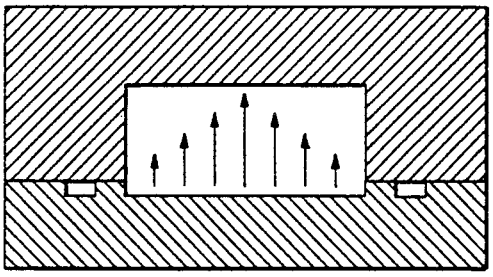
FIG. 11 is a transverse sectional elevational view of said transition, taken along line 11—11 of FIG. 10, showing a rectangular waveguide configuration and its associated $TE_{10}$ electrical field arrangement.
Figure 12:
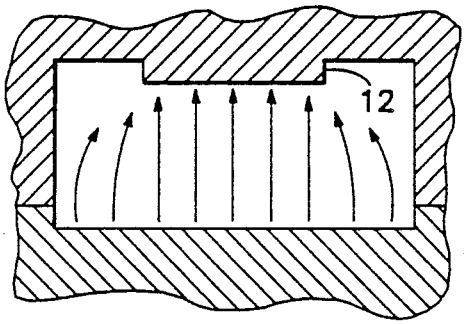
FIGS. 12–14 are transverse sectional elevational views of said transition showing ridge waveguide configurations and their respective associated electrical field arrangements, taken along lines 12—12, 13—13, and 14—14, respectively, of FIG. 10.
Figure 13:
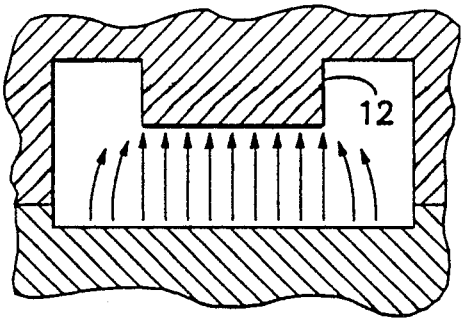
Figure 14:
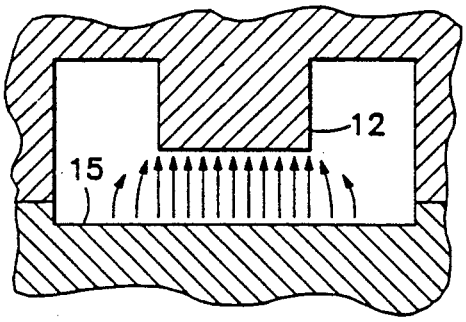

Sectional views of the transition taken at right angles to the sectional view of FIG. 10 show the change in the electrical field's configuration. FIG. 11 shows the transition where it is a rectangular waveguide in cross-section. The vertical lines represent the strength of the electrical field associated with transmission mode $TE_{01}$. The views of FIGS. 12–14 show the progressive increase in the extension of the ridge 12 and the corresponding concentration of the electrical field between the ridge 12 and the floor 15.

It will be appreciated that steps are not necessary for proper functioning of the transition 30; a smooth progression along a locus of corner positions as shown in FIG. 6 would be functional, though possibly more difficult to manufacture. Also, in the transition shown, the trough 14 remains constant in width $a_3$, while the width $a_2$ of the ridge 12 varies. It will be appreciated that any or all of the dimensions of the transition may vary, as long as the desired criteria of cutoff frequency $f_c$ and characteristic impedance $Z_0$ are met.

The terms and expressions which have been employed in the foregoing specification are used therein as terms of description and not of limitation, and there is no intention, in the use of such terms and expressions, of excluding equivalents of the features shown and described or portions thereof, it being recognized the scope of the invention is defined and limited only by the claims which follow.

What is claimed is:

1. A ridge-trough waveguide, comprising a conductive tubular waveguide having an internal longitudinal ridge directly opposing an internal longitudinal trough.

2. The ridge-trough waveguide of claim 1, wherein said tubular waveguide is rectangular in transverse cross-section.

3. The ridge-trough waveguide of claim 1, wherein said longitudinal ridge has a transverse width narrower than the transverse width of said longitudinal trough.

4. The ridge-trough waveguide of claim 3, wherein said longitudinal ridge extends within said longitudinal trough.

* * * * *